US007774960B2

(12) United States Patent
Whelan

(10) Patent No.: US 7,774,960 B2
(45) Date of Patent: Aug. 17, 2010

(54) APPARATUS FOR APPLYING CANVAS TO FRAME

(76) Inventor: Aidan Joseph Whelan, Bodeen, Ratoath, County Meath (IE)

( * ) Notice: Subject to any disclaimer, the term of this patent is extended or adjusted under 35 U.S.C. 154(b) by 831 days.

(21) Appl. No.: 10/572,258

(22) PCT Filed: Sep. 20, 2004

(86) PCT No.: PCT/IB2004/003057

§ 371 (c)(1),
(2), (4) Date: Dec. 13, 2006

(87) PCT Pub. No.: WO2005/028216

PCT Pub. Date: Mar. 31, 2005

(65) Prior Publication Data

US 2007/0194078 A1 Aug. 23, 2007

(30) Foreign Application Priority Data

Sep. 19, 2003 (IE) ..... S2003/0690

(51) Int. Cl.
*D06C 3/08* (2006.01)
*D06C 3/00* (2006.01)

(52) U.S. Cl. ..... 38/102; 38/102.91

(58) Field of Classification Search ..... 38/102.1, 38/102.21, 102, 102.91; 160/371, 378, 382, 160/402; 101/127–128.1
See application file for complete search history.

(56) References Cited

U.S. PATENT DOCUMENTS 981,450 A * 1/1911 McClain ..... 38/102.1
2,693,340 A * 11/1954 Shirak ..... 254/217
3,391,635 A * 7/1968 Matheus ..... 101/127.1
3,466,706 A * 9/1969 Asano ..... 269/94
4,244,558 A 1/1981 Guy
4,317,301 A * 3/1982 Timphony et al. ..... 38/102
5,063,842 A * 11/1991 Clarke ..... 101/127.1
5,096,524 A * 3/1992 Ohtani et al. ..... 156/160
5,562,030 A * 10/1996 Karlyn et al. ..... 101/127.1
5,581,918 A * 12/1996 Schilling et al. ..... 38/102.1
5,913,263 A * 6/1999 Hruska ..... 101/114

FOREIGN PATENT DOCUMENTS

WO WO/95/30554 11/1995

* cited by examiner

*Primary Examiner*—Ismael Izaguirre
(74) *Attorney, Agent, or Firm*—Gray Law Firm; Gordon E. Gray, III

(57) ABSTRACT

An apparatus (100) for applying canvas to a frame comprising a surface (112) for supporting a sheet of canvas and a frame, a pair of parallel members (114) mounted on the support surface of the apparatus, means (141) for retaining the canvas and the frame on the support surface and control means for controlling operation of the apparatus. Each member (114) has a clamping bar arrangement (128) operable to engage a side end of the canvas to be applied, a stretcher bar (137), clamping drive means (125) operable to engage the canvas against side edges of the frame and stretcher bar drive means (139) operable to stretch the canvas over the edge of the frame and retain the canvas in the stretched state to enable the canvas to be secured to the frame. Means (129) for adjusting the clamping bar arrangement (128) and the clamping drive means (125) are provided.

4 Claims, 9 Drawing Sheets

APPARATUS FOR APPLYING CANVAS TO FRAME

The present invention relates to apparatus for applying canvas to a frame, such as a rectangular timber mounting frame.

In the prior art, applying canvas to a frame is a laborious and time consuming task. One side of the canvas is stapled to one side of the frame and the canvas is stretched by hand over the frame and secured in position on each of the other sides of the frame. The work is very slow and it is difficult to ensure uniformity of stretching of the canvas in all directions. The task has been automated to some extent in recent years with hydraulic means being employed to perform the stretching of the canvas. However, problems persist in obtaining uniformity in the tension applied to the canvas at different locations on the frame.

It is the object of the present invention to provide an improved apparatus for applying canvas to a frame in which the tension applied to the canvas at particular points on the frame can be adjusted to take account of variations in frame strength, canvas strength and the flexibility of the canvas.

Accordingly, the present invention provides an improved apparatus for applying canvas to a frame.

According to a first aspect of the invention, there is provided an apparatus for applying canvas to a frame comprising a surface for supporting a sheet of canvas and a frame, a pair of parallel members mounted on the support surface of the apparatus, means for retaining the canvas and the frame on the support surface and control means for controlling operation of the apparatus; each member having a clamping bar arrangement operable to engage a side end of the canvas to be applied, a stretcher bar, clamping drive means operable to engage the canvas against side edges of the frame and stretcher bar drive means operable to stretch the canvas over the edge of the frame and retain the canvas in the stretched state to enable the canvas to be secured to the frame.

Preferably, the clamping bar arrangement and the clamping drive means include adjustment means to take account of varying frame strength, canvas strength and canvas flexibility.

Ideally, the clamping drive means comprises at least two pneumatically operated cylinder rams.

In a preferred arrangement, one of the said parallel members mounted on the support surface of the apparatus is fixed and the other is adjustable to different positions along guide rails on the support surface.

Conveniently, the adjustable member mounted on the support surface includes locking means for locking the member in a position along the guide rail.

Preferably, the clamping bar arrangement comprises a first and a second clamping bar hingedly fixed together at their ends, each of the clamping bars having a contact plate, the first clamping bar being fixed relative to the second clamping bar and the second clamping bar being moveable between an open position in which the clamping bars are substantially spaced apart and a closed position in which the clamping bars are brought together.

Advantageously, in the closed position, the contact plates of the clamping bars are in close contact. In the closed position, a side end of a canvas to be applied is held between the contact plates of the clamping bars.

Conveniently, adjustment means are provided for adjusting the spacing between the contact plates of the clamping bars in the closed position.

Ideally, the clamping bar arrangement includes a handle for moving the second clamping bar between the open and the closed positions.

In a particular convenient arrangement the clamping drive means is further operable to move the second clamping bar between the open and the closed positions.

Advantageously, the surfaces of the contact plates include gripping means for gripping the canvas. The gripping means may comprise ribbed or moulded proturbances.

Ideally, the stretcher bar drive means includes at least one pneumatically operated cylinder ram and is operable to push the stretcher bar over the edge of the frame such that canvas held between the contact surfaces of the clamping bars withdraws between the contact surfaces as the canvas is extended into a stretched state over and against the frame. The stretcher bar drive means may include adjustment means to change the distance to which the stretcher bar extends over the frame.

Preferably, control means are provided comprising a control unit connected to an air supply and two toggle switches, operable to activate the clamping drive means and the stretcher bar drive means respectively.

Advantageously, the support surface of the apparatus may be disposed at an angle of up to 70 degrees to the horizontal.

According to a second aspect of the invention, there is a provided an apparatus for applying canvas to a frame comprising a surface for supporting a sheet of canvas and a frame, a pair of parallel clamp members operable to engage side edges of the frame and stretch the canvas over the edge of the frame to tighten it and to retain the canvas in its stretched state to enable the canvas to be secured to the frame.

Preferably, the clamp members comprise a contact plate, a pressure plate located behind the contact plate and drive means operable to push the pressure plate and the contact plate.

Ideally, the drive means comprises at least one pneumatically operated cylinder ram.

Advantageously, the surface of the contact plate includes gripping means for gripping the canvas.

The apparatus may include means for retaining the frame and the canvas on the support surface of the apparatus.

Preferably, vertical clamping members are provided for securing the parallel clamp members to the support surface of the apparatus.

Conveniently slots disposed in the support surface of the apparatus are provided for allowing movement of the parallel clamp members laterally along the support surface, the vertical clamping members being disposed through the slots.

Ideally, control means are provided and are operable to control the drive means of the apparatus.

According to a third aspect of the invention, there is provided an apparatus for applying canvas to a frame comprising a surface for supporting a sheet of canvas and a frame; and a pair of parallel members mounted on the support surface of the apparatus; each member having a clamping bar arrangement operable to engage a side end of the canvas to be applied, a stretcher bar operable to stretch the canvas over the edge of the frame and a manually rotatable shaft operable to move the clamping bar arrangement and the stretcher bar between a first position in which the canvas to be applied is unstretched and a second position in which the canvas is retained in the stretched state to enable the canvas to be secured to the frame.

Preferably, the shaft includes two cam members disposed at either end of the shaft and engaged against a block member respectively, each block member connecting a spring-loaded ram through the parallel member to the stretcher bar and the clamping bar arrangement.

Ideally, clamping bar arrangement comprises a first and a second clamping bar hingedly fixed together at their ends, each of the clamping bars having a contact plate, the first clamping bar being fixed relative to the second clamping bar and the second clamping bar being moveable between an open position in which the clamping bars are substantially spaced apart and a closed position in which the clamping bars are brought together.

Advantageously, in the closed position, the contact plates of the clamping bars are in close contact. In the closed position, a side end of a canvas to be applied is held between the contact plates of the clamping bars.

Conveniently, adjustment means are provided for adjusting the spacing between the contact plates of the clamping bars in the closed position.

Ideally, the clamping bar arrangement includes a handle for moving the second clamping bar between the open and the closed positions.

Advantageously, the surfaces of the contact plates include gripping means for gripping the canvas. The gripping means may comprise ribbed or moulded proturbances.

Preferably, the clamping bar arrangement includes adjustment means to take account of varying frame strength, canvas strength and canvas flexibility.

The invention will now be described more particularly with reference to the accompanying drawings which show, by way of example only, embodiments of a display device according to the invention. In the drawings.

Figure 1:
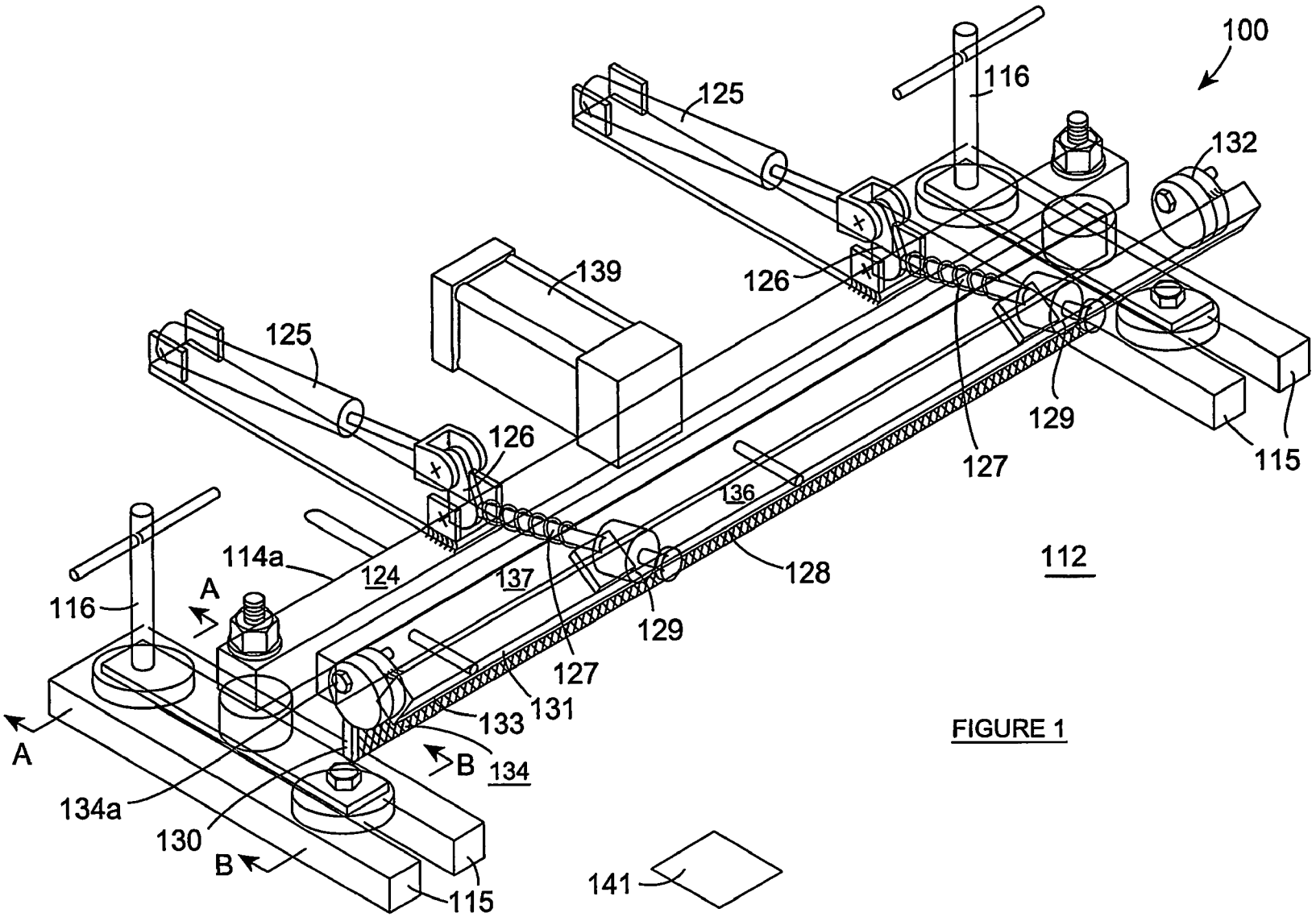
FIG. 1 is a perspective view of the apparatus according to the invention showing the adjustable parallel assembly.
Figure 2:
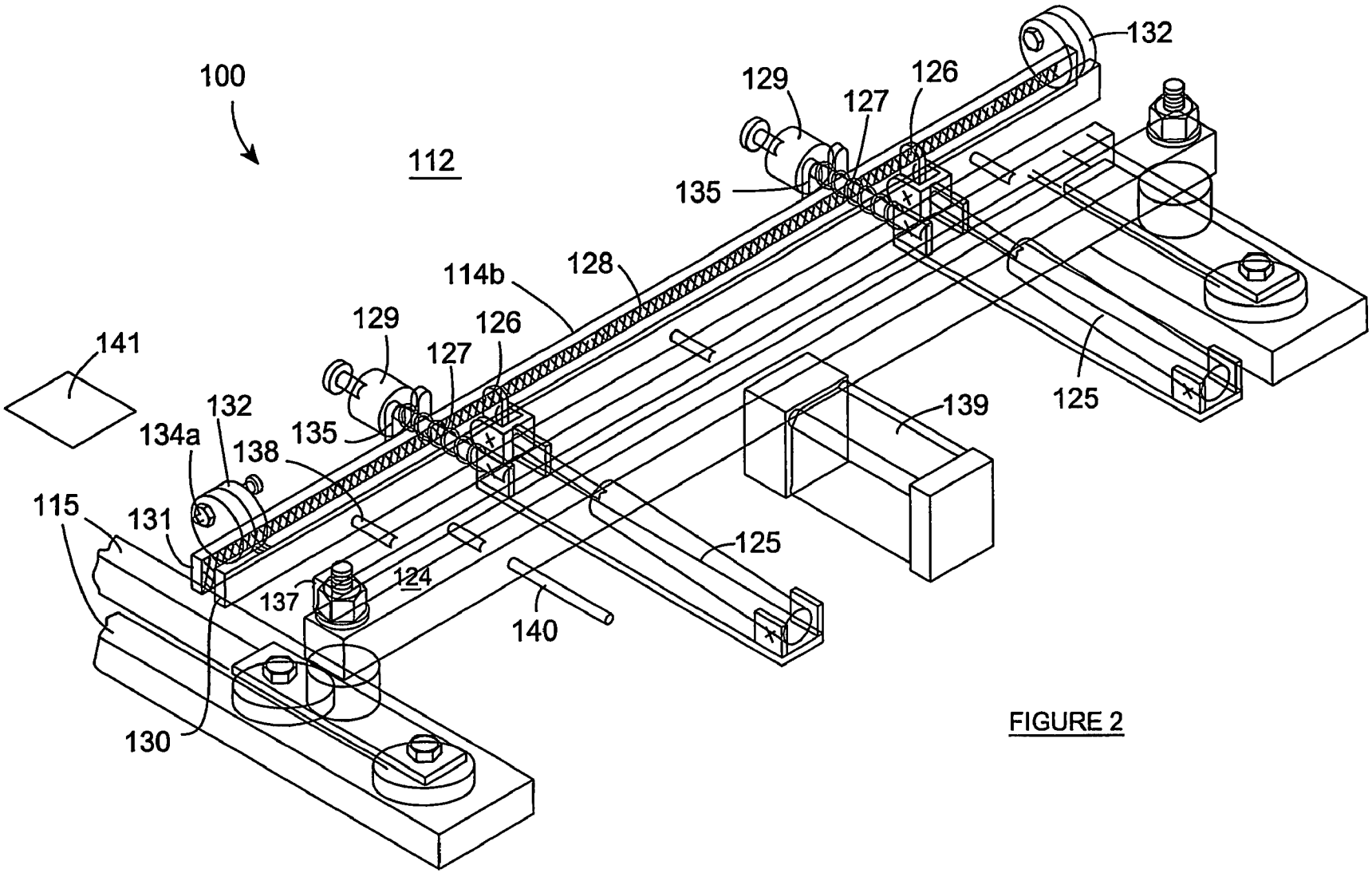
FIG. 2 is a perspective view of the apparatus of FIG. 1 showing the fixed parallel assembly.
Figure 3:
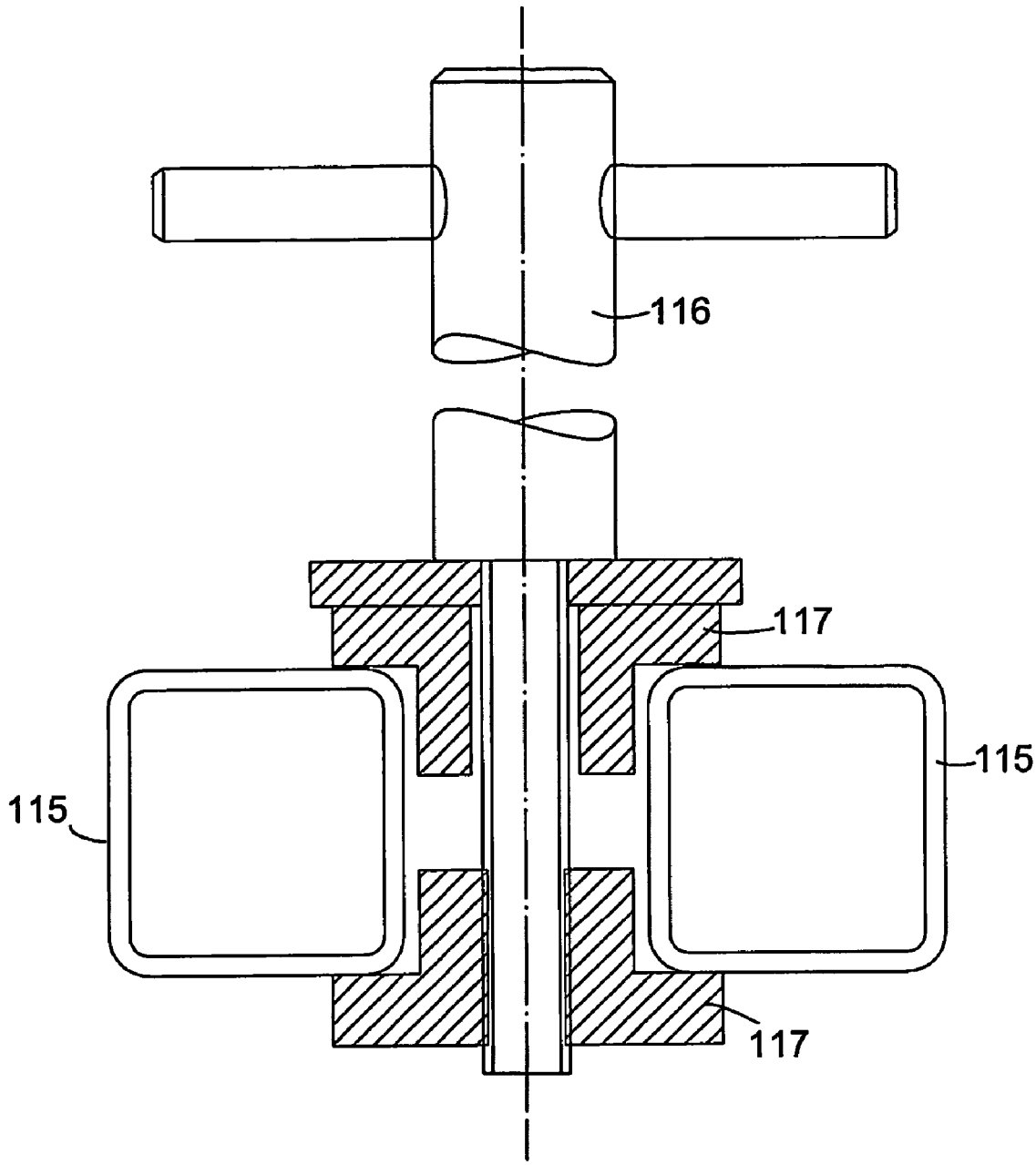
FIG. 3 is a cross-sectional view of the apparatus of FIG. 1 along the section line A-A.
Figure 4:
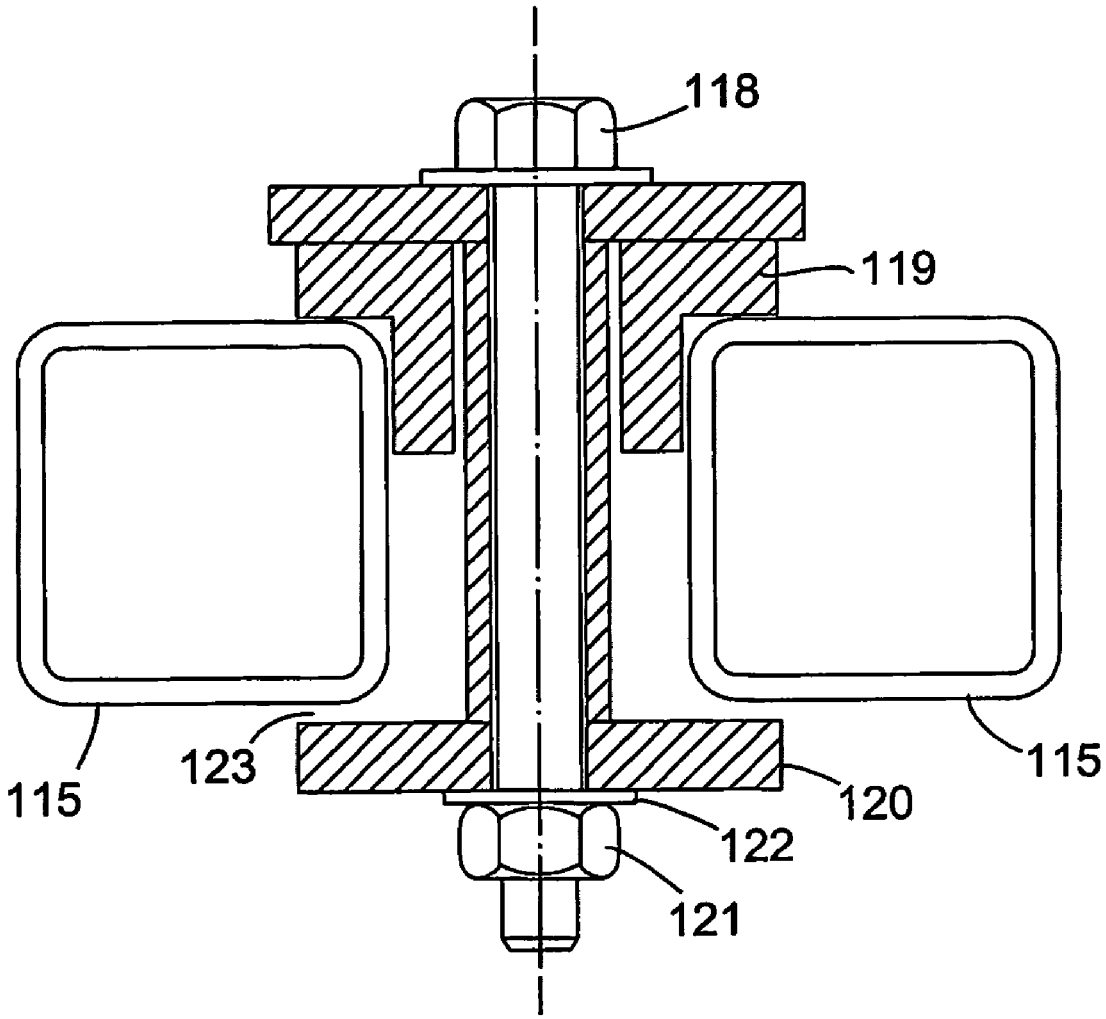
FIG. 4 is a cross-sectional view of the apparatus of FIG. 1 along the section line B-B.

Referring to the drawings and initially to FIGS. 1 to 4, a first and preferred embodiment of an apparatus 100 for applying canvas to a frame is shown. The apparatus 100 comprises a table (not shown) or other such suitable support structure having a flat supporting surface 112 and a pair of parallel assemblies 114 mounted on opposite sides of the supporting surface 112. One of the assemblies 114*a* is adjustably mounted on the supporting surface and the other assembly 114*b* is fixedly mounted thereon. Pairs of guide rails 115 run along the top and base of the supporting surface 112 and can form an integral part of the support surface or alternatively be mounted onto the support surface. The assembly 114*b* is fixedly mounted through the guide rails 115 to the supporting surface. Adjustable assembly 114*a* is similarly mounted through the guide rails to the supporting surface but has a T-shaped locking rod 116 for releasably fixing the assembly 114*a* at any desired position along the length of the guide rails. This facilitates use of the apparatus for applying canvas to a variety of frame sizes. As shown in FIG. 3, the locking rod 116 extends down between the guide rails through a locking nut 117. Assembly 114*a* is also mounted through the guide rails 115 to the supporting surface 112 at a second point. FIG. 4 shows a sectioned view of the assembly 114*a* at this point. A screw 118 extends down between the guide rails through a locking nut 119 and is secured by a lower locking plate 120, a threaded nut 121 and a washer 122. A gap 123 exists between the lower locking plate 120 and the underside of the guide rails 115 such that when the locking rod 116 is unsecured, the assembly 114*a* is easily slideable along the guide rails to a desired position.

Referring again to FIGS. 1 and 2, the assemblies 114*a*, 114*b* comprise an elongate support bar 124 extending between the guide rails at the top and the guide rails at the base of the supporting surface 112. Two pneumatically operated cylinder rams 125 act on pivot knuckles 126 located on top of the support bar 124. Spring-loaded arms 127 are connected between the pivot knuckles and a clamping bar assembly 128. The tension exerted on the clamping bar assembly 128 and the canvas itself is adjustable using clamping drum adjusters 129 at the ends of the arms 127. The adjusters can be individually set to vary the tension exerted on the canvas at different positions along the frame edge. Particularly, the tension of the canvas applied to a frame can be set depending on requirements by using the adjusters 129. The tension may be varied to take account of factors such as the strength of the frame, the strength of the canvas and the flexibility of the canvas. The adjusters 129 may be set to ensure there is no slippage or alternatively some slippage of the canvas during the clamping and stretching stages. The clamping bar assembly 128 consists of a first elongate clamping bar 130 and a second elongate clamping bar 131 hingedly fixed together at their ends through circular hinges 132. Clamping bar 130 is fixed relative to clamping bar 131 which is moveable under the action of the hinges 132 between a position in which the clamping bars 130, 131 are open as illustrated in FIG. 1 and a position in which the clamping bars 130, 131 are closed as illustrated in FIG. 2. Each clamping bar 130, 131 includes a contact plate 133 having a gripping surface in the form of ribbed or moulded proturbances 134. With the clamping bars 130, 131 in a closed position, the contact plates 133 of the clamping bars are facing each other and are spaced substantially close together so that a side end (not shown) of a canvas to be applied to a frame is held between the contact plates 133. The ribbed or moulded proturbances help create a friction grip on the canvas to hold it between the contact plates. Clamping bar 131 is moved between the open position as illustrated in FIG. 1 and the closed position as illustrated in FIG. 2 using a handle (not shown) attached to a nut 134*a* on one or both of the circular hinges 132. Clamping bar 131 is also closeable against clamping bar 130 under the action of the cylinder rams 125 acting on the arms 127. The spring loaded arms 127 are connected to the clamping bar 131 through U-shaped plates 135 projecting from the outer surface 136 of the clamping bar 131. The clamping drum adjusters 129 rest against the plates 127.

Assemblies 114*a*, 114*b* further comprise a stretcher bar in the form of a pressure plate 137. The pressure plate 137 is located behind and slightly below the clamping bar assembly 128. The clamping bar assembly 128 and the pressure plate are connected by rods 138 extending between them. A pneumatically operated cylinder ram 139 is operable to push the pressure plate and the clamping bar assembly 128 with clamping bars 130, 131 in a closed position. In use, this causes the canvas held between the clamping bars to clamp against and stretch over and against the frame edges. Support rods 140, extendable under the action of cylinder ram 139, project through the support bar 124 and connect to the pressure plate 137. A control unit (not shown) is located away from the support surface 112 of the support structure. Both the clamping cylinder rams 125 and the stretcher bar ram 139 are activated using separate toggle switches (also not shown) disposed adjacent the control unit. It is to be understood that the pressure plate may be acted on by more than one cylinder ram 139 depending on the size and type of the apparatus.

Similarly, multiple cylinder rams 125 may be disposed along the length of the assemblies 114*a*, 114*b* if required.

The apparatus will now be described in use.

A sheet of canvas (not shown) is laid flat on the supporting surface 112. A lower edge of the canvas rests behind a stopper 141 located towards a side of support surface 112 preventing any slipping or movement of the canvas on the surface. The frame (also not shown) to which the canvas is to be applied is then laid over the canvas so that it rests against the top of the stopper 141 ensuring the frame does not move during the process of applying the canvas to the frame. The edges of the canvas are folded over two parallel sides of the frame such that the canvas ends project between the clamping bars 130, 131 in the open position. The clamping bar 131 is then closed against clamping bar 130 such that the canvas is held between the contact plates 133 of the bars. The pneumatically operated cylinder rams 125 are then activated using the appropriate toggle switch causing the pivot knuckles 126 to pivot forward projecting the spring-loaded arms 127 forward and compressing the springs of the arms 127 against the U-shaped plates 135. The apparatus is now said to be in the clamped state. Pneumatically operated cylinder ram 139 is then activated using the appropriate toggle switch causing the pressure plate 137 to push forward. Cylinder ram 139 also acts to push the clamping bar assembly 128 forward with the canvas held between the clamping bars 130, 131 withdrawing through the bars as the pressure plate 137 stretches the canvas over and against the frame. Typically, the size of the sheet of canvas should be sufficiently large to ensure a significant overlap of the canvas material against the frame. The ribbed or moulded proturbances 134 on the contact plate 133 create a friction grip with the canvas as it withdraws through the bars and helps to retain tightness of the canvas and alleviate slipping. While the clamping bars 130, 131 and the pressure plate 137 are engaged against the frame and the canvas stretched over the frame, the overlapping canvas is stapled to the back of the frame by a line of staples parallel to the support bar 124. The clamping bar assembly 128 is then released by operating the toggle switch to retract the cylinder rams 125. The clamping bars 130, 131 are now opened. The pressure plate 137 is then withdrawn by operating the appropriate toggle switch to retract the cylinder ram 139. The canvas is secured to the other two sides of the frame by lifting the frame from the supporting surface 112, rotating it ninety degrees, placing the canvas and frame back on the support surface 112, folding the remaining two edges of the canvas over the other two parallel sides of the frame such that the canvas ends project between the clamping bars 130, 131 in the open position and repeating the same procedure as described above.

Figure 5:
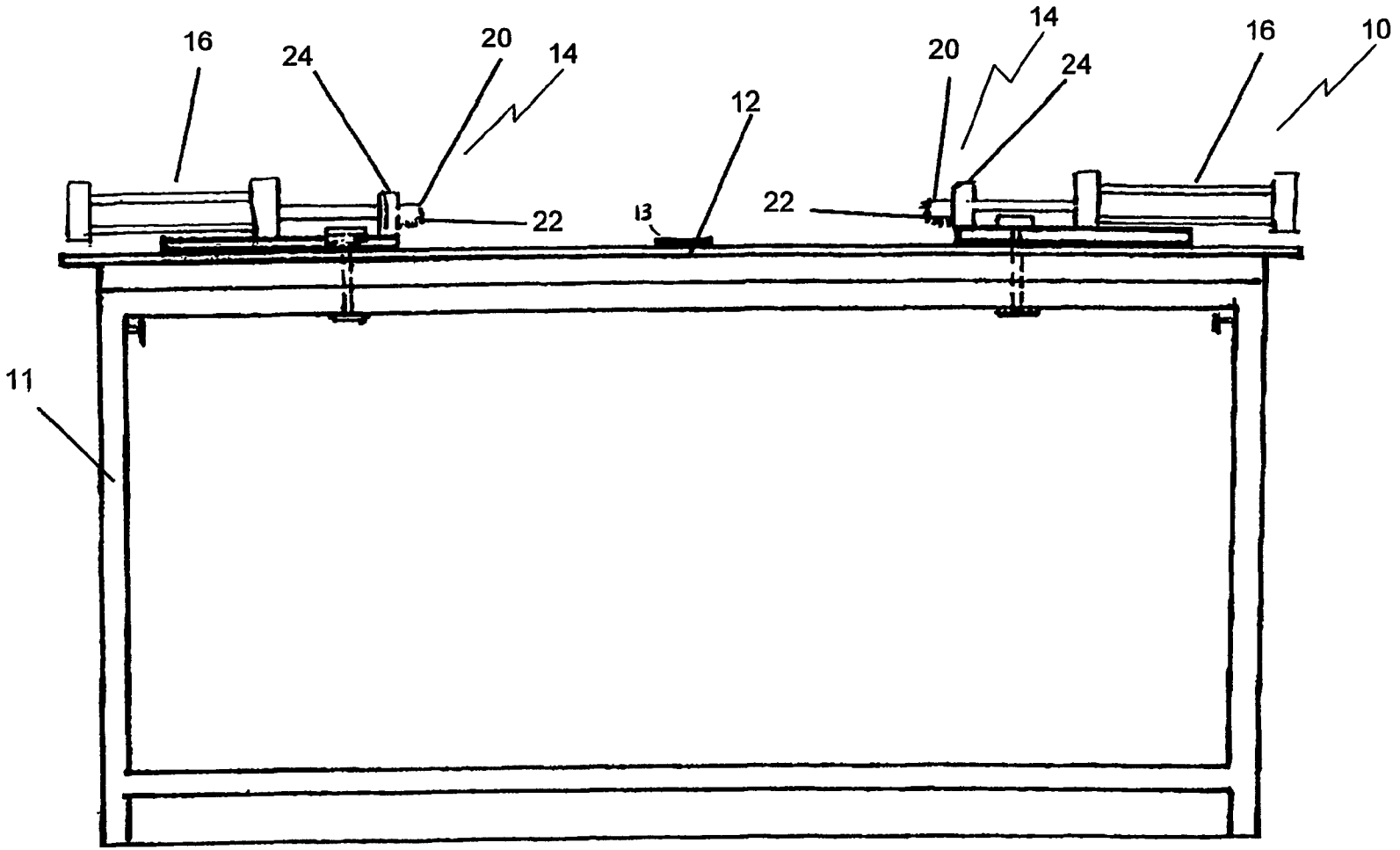
FIG. 5 is a side view of an apparatus according to a second aspect of the invention.
Figure 6:
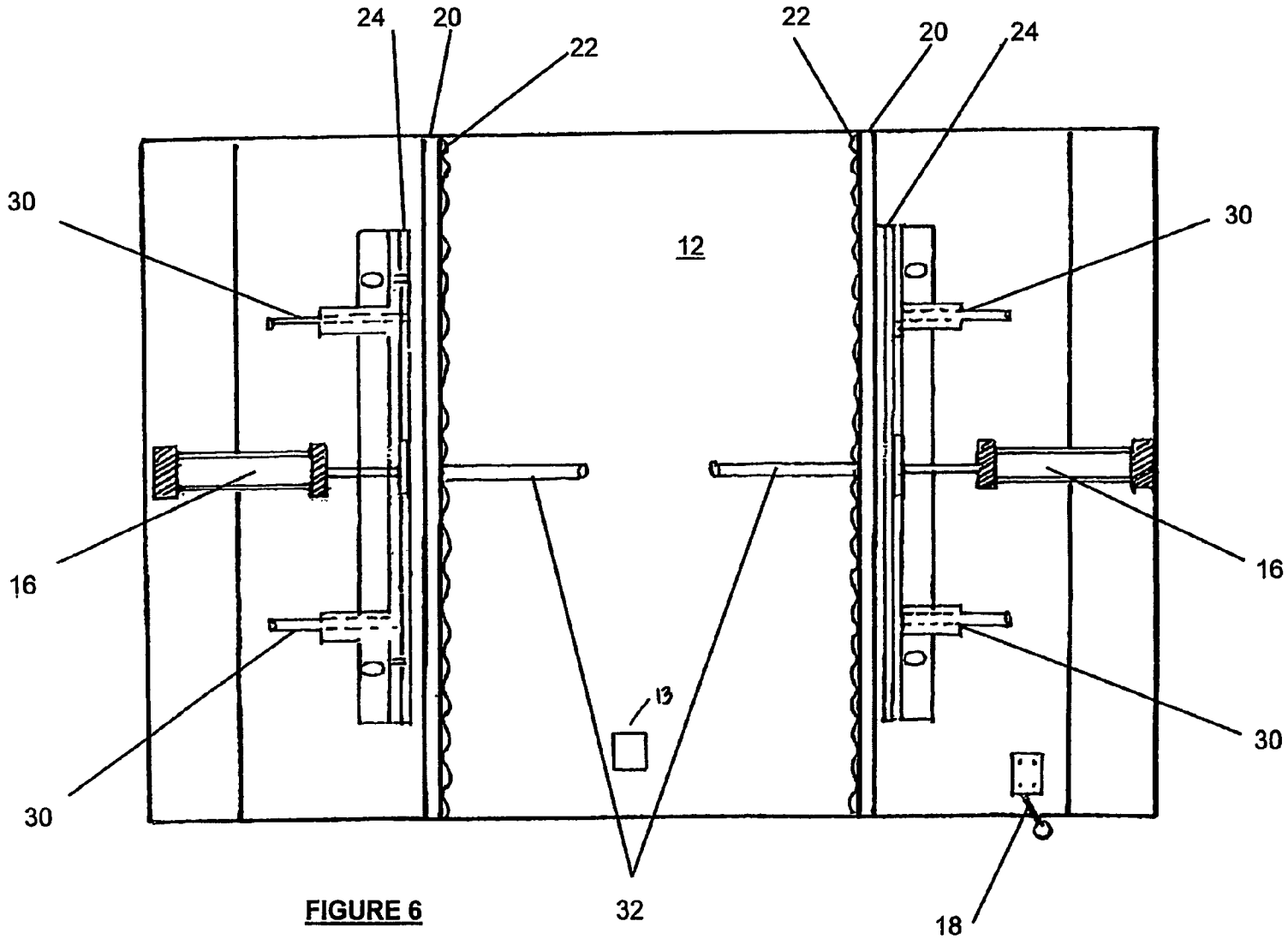
FIG. 6 is a plan view of the apparatus of FIG. 5.
Figure 7:
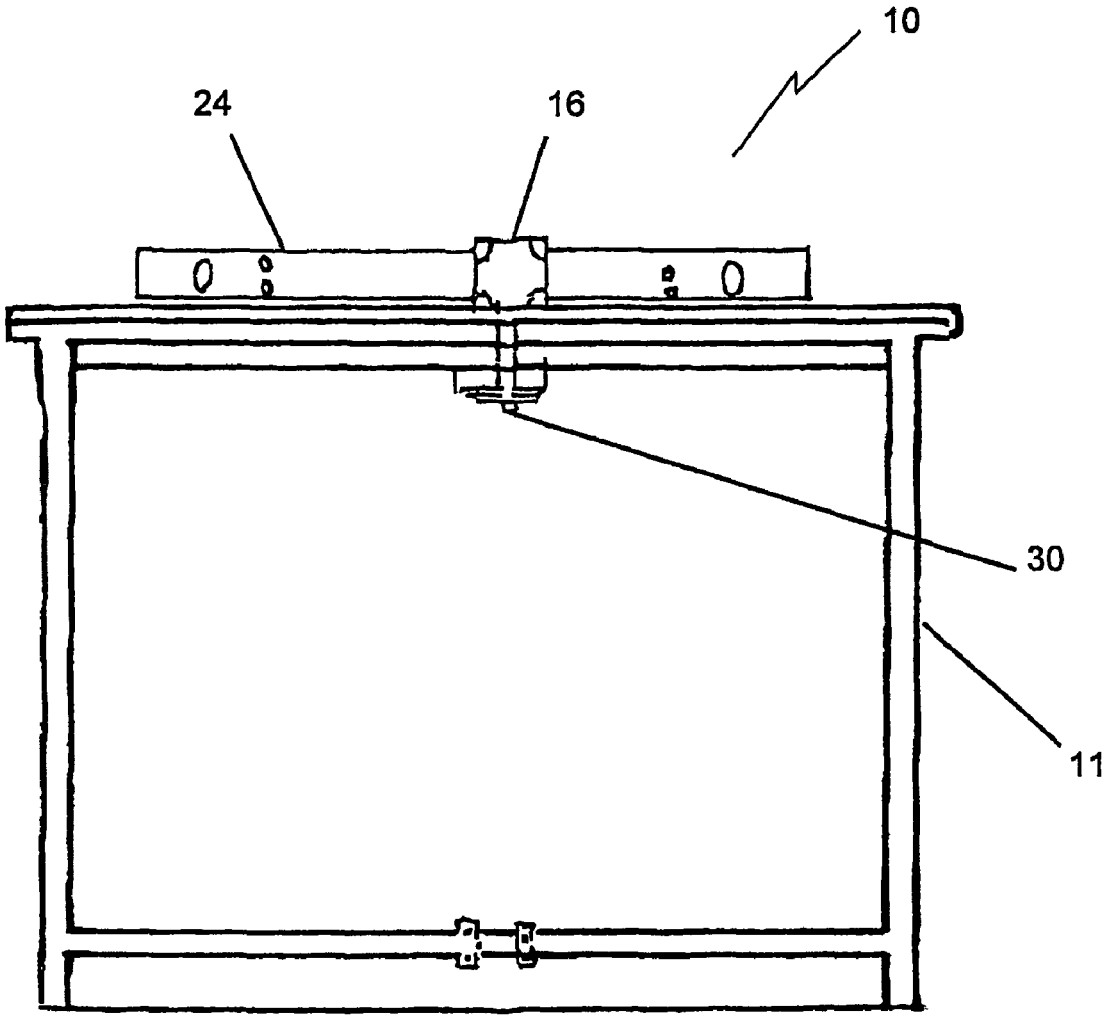
FIG. 7 is an end view of the apparatus of FIG. 5.

Referring to FIGS. 5 to 7 of the drawings, a second embodiment of an apparatus for applying canvas to a frame according to the present invention is shown. The apparatus 10 comprises a table 11 having a flat supporting surface 12 and a pair of moveable clamps 14. The clamps are mounted on opposite sides of the supporting surface 12, extend along the width of the table and are disposed parallel to each other.

Each of the clamps 14 is moveable by means of a pneumatically operated cylinder ram 16 which is operated by means of a lever 18 at the side of the table. Each clamp 14 comprises an elongate contact plate 20 to which a ribbed or moulded rubber face 22 is attached. The purpose of the ribbed or moulded rubber face 22 on the contact plate 20 is to help create a friction grip between the contact plate and the canvas when they come into contact. This gripping action prevents slipping of the canvas against the contact plate and improves the clamping and stretching actions of the clamps 14 when they engage the frame. A pressure plate 24 is located directly behind the contact plate 20 and is driven by the cylinder ram 16 for the purpose of perpendicularly moving the clamps 14 so that they remain parallel during motion. This ensures uniform pressure and stretching is exerted on the canvas. Depending on the size of the frame to which canvas is being applied to, the clamps 14 can be set at particular fixed positions by opening vertical table clamps 30 and moving the clamps 14 to the desired position along positioning slots 32. The slots 32 are disposed in the surface 12 of the table and extend centrally along the supporting surface allowing for canvas to be applied to a variety of frame sizes.

In use, a sheet of canvas (not shown) is laid flat on the supporting surface 12. A lower edge of the canvas rests behind a stopper 13 located towards a side of support surface 12 preventing any movement of the canvas on the surface. The frame (also not shown) to which the canvas is to be applied is then laid over the canvas so that it rests against the top of the canvas slip stopper ensuring the frame does not move during the process of applying the canvas to the frame. The edges of the canvas are folded over two parallel sides of the frame disposed between the clamps 14. The lever 18 is operated to activate the clamps 14 to push against the frame and stretch the canvas over and against the side and top edges of the frame sides, the cylinder rams 16 extending and pushing the pressure plates 24 of the clamps. Typically, the size of the sheet of canvas should be sufficiently large to ensure a significant overlap of the canvas material against the frame. The ribbed or moulded rubber face 22 on the contact plate 20 creates a friction grip with the canvas as it is pushed against the frame. While the clamps are still secured against the canvas and the canvas stretched over the frame, the overlapping canvas is stapled to the back of the frame by a line of staples parallel to the clamps 14. The clamps 14 are then released by operating the lever to retract the cylinder rams 16. The canvas is secured to the other two sides of the frame by lifting the frame from the supporting surface 12, rotating it ninety degrees, folding the remaining two edges of the canvas over the other two parallel sides of the frame, replacing it on the table surface and repeating the same procedure. It is to be understood that any suitable securing means or device, not limited to a staple gun can be used for the purpose of securing the canvas to the frame.

Figure 8:
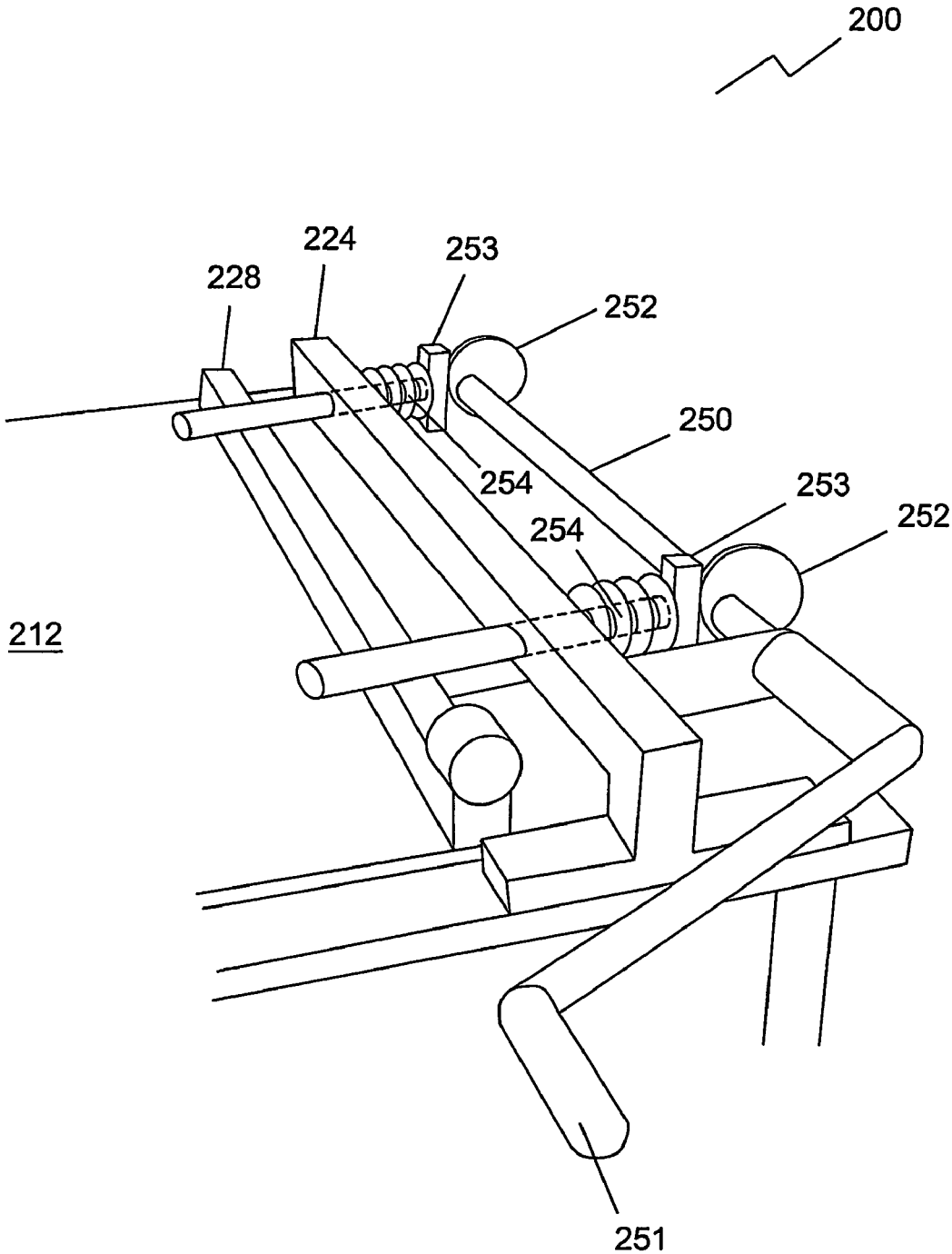
FIG. 8 is a perspective view of one side of an apparatus according to a third aspect of the invention.
Figure 9:
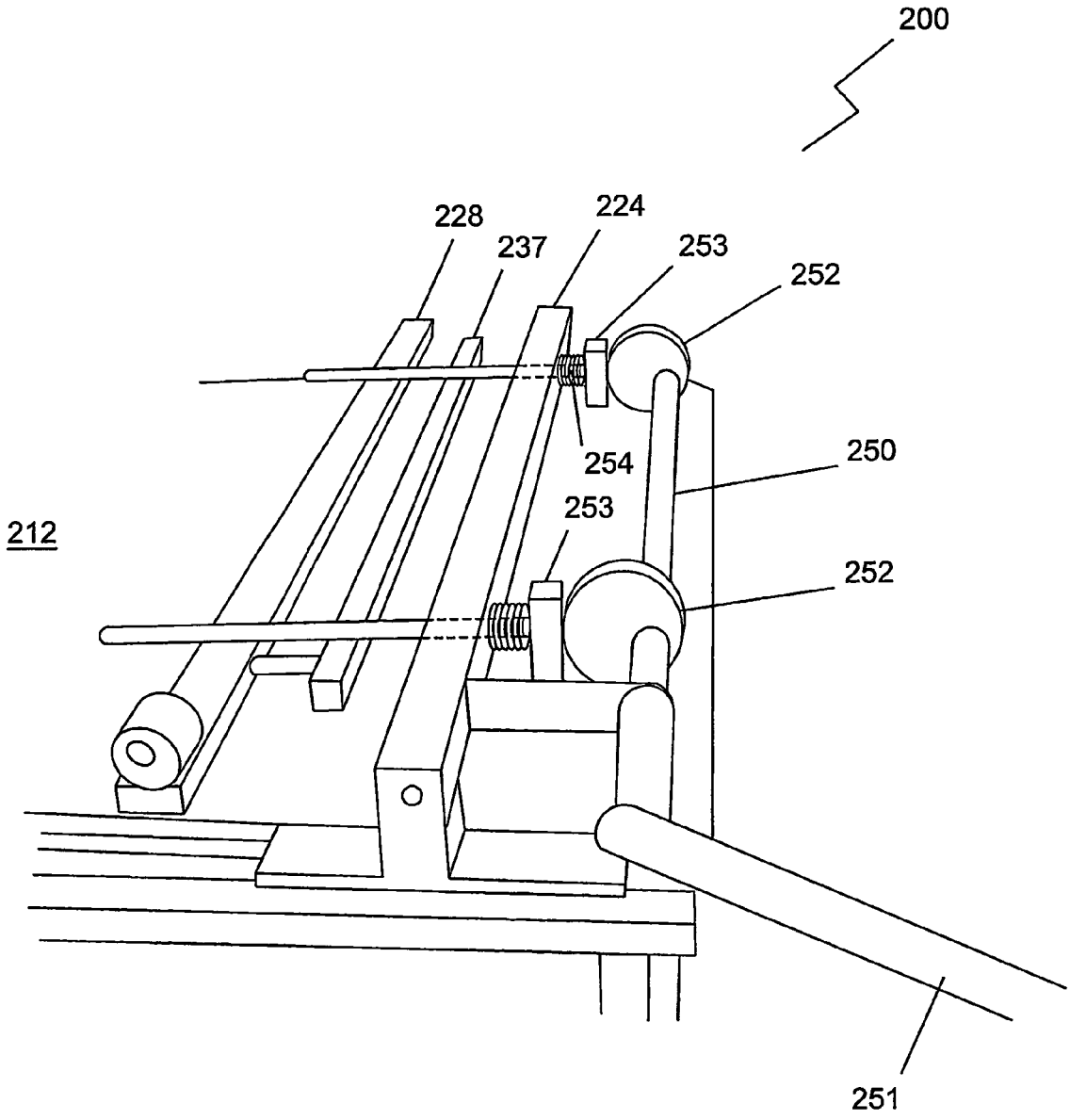
FIG. 9 is a second perspective view of the apparatus of FIG. 8.

Referring to FIGS. 8 and 9 of the drawings, a third embodiment of an apparatus for applying canvas to a frame according to the present invention is shown. The features of this embodiment of the apparatus are essentially the same as those for the first embodiment with the present embodiment of the apparatus similarly comprising a support surface 212, a support bar 224, a clamping bar assembly 228 and a stretcher bar in the form of a pressure plate 237. The apparatus insofar as these common features are concerned operate in the same manner as described previously for the first embodiment. The only difference between the present embodiment and the first embodiment is that instead of pneumatically operable cylinder rams being used to move the clamping assembly and stretcher bar, a manually rotatable shaft is employed. An elongate shaft 250 extending along the length of the support bar 224 is rotatable using a handle 251. The shaft 250 has two cam members 252 disposed at opposite ends of the shaft and operable to rotate against blocks 253, the blocks acting to extend or retract a spring-loaded rods 254 under the action of the cam members 252 against the blocks 253. FIG. 8 illustrates the shaft 250 in a first position with the rod 254 in a retracted state. By rotating the handle 251 of the shaft 250 to a second position, as illustrated in FIG. 9, the spring-loaded rods 254 extends through the support bar 224 against the action of the cam members 252 on the blocks. Consequently, the clamping bar assembly 228 and the pressure plate 237 act on the canvas and frame in the same manner as described previously for the first embodiment.

It is to be understood that the invention is not limited to the specific details described herein, which are given by way of example only, and that various modifications and alterations are possible without departing from the scope of the invention as defined by the appended claims.

The invention claimed is:

1. An apparatus for applying canvas to a frame comprising a surface for supporting a sheet of canvas and a frame, a pair of parallel members mounted on the support surface of the apparatus means for retaining the canvas and the frame on the support surface and control means for controlling operation of the apparatus; each member having a clamping bar arrangement operable to engage a side end of the canvas to be applied, a stretcher bar, clamping drive means operable to engage the canvas against side edges of the frame and stretcher bar drive means operable to stretch the canvas over the edge of the frame and retain the canvas in the stretched state to enable the canvas to be secured to the frame: where the support surface of the apparatus is disposed at an angle of up to 70 degrees to the horizontal.

2. An apparatus for applying canvas to a frame comprising a surface for supporting a sheet of canvas and a frame, a pair of parallel clamp members operable to engage side edges of the frame and stretch the canvas over the edge of the frame to tighten it and to retain the canvas in its stretched state to enable the canvas to be secured to the frame; and further comprising vertical clamping members for securing the parallel clamp members to the support surface of the apparatus.

3. The apparatus for applying canvas to a frame of claim 2 further comprising slots disposed in the support surface of the apparatus for allowing movement of the parallel clamp members laterally along the support surface, the vertical clamping members being disposed through the slots.

4. An apparatus for applying canvas to a frame comprising a surface for supporting a sheet of canvas and a frame; and a pair of parallel members mounted on the support surface of the apparatus; each member having a clamping bar arrangement operable to engage a side end of the canvas to be applied, a stretcher bar operable to stretch the canvas over the edge of the frame and a manually rotatable shaft operable to move the clamping bar arrangement and the stretcher bar between a first position in which the canvas to be applied is unstretched and a second position in which the canvas is retained in the stretched state to enable the canvas to be secured to the frame; where the manually rotatable shaft includes two cam members disposed at either end of the shaft and engaged against a block member respectively, each block member connecting a spring-loaded ram through the parallel member to the stretcher bar and the clamping bar arrangement.

* * * * *